US010440462B1

(12) United States Patent
Lee

(10) Patent No.: US 10,440,462 B1
(45) Date of Patent: Oct. 8, 2019

(54) EARPHONE ASSEMBLY AND SOUND CHANNEL CONTROL METHOD APPLIED THEREIN

(71) Applicant: Cheng Uei Precision Industry Co., Ltd., New Taipei (TW)

(72) Inventor: James Lee, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 4 days.

(21) Appl. No.: 15/936,586

(22) Filed: Mar. 27, 2018

(51) Int. Cl.
*H04R 1/10* (2006.01)

(52) U.S. Cl.
CPC ..... *H04R 1/1066* (2013.01); *H04R 1/105* (2013.01); *H04R 1/1016* (2013.01); *H04R 2420/03* (2013.01)

(58) Field of Classification Search
CPC .... H04R 1/1066; H04R 1/1016; H04R 1/105; H04R 2420/03; H04R 2420/07; H04S 7/303; H04S 7/304; H04S 7/308
See application file for complete search history.

(56) References Cited

U.S. PATENT DOCUMENTS 5,687,239 A * 11/1997 Inanaga ..... H04S 7/304 381/309
8,472,653 B2 * 6/2013 Kon ..... H04S 1/002 381/17
9,137,598 B2 * 9/2015 Chang ..... H04R 5/033
9,237,393 B2 * 1/2016 Abrahamsson ..... H04R 1/1016
9,351,090 B2 * 5/2016 Tachibana ..... H04R 1/1041
2002/0164037 A1 * 11/2002 Sekine ..... H04S 7/304 381/18
2003/0002705 A1 * 1/2003 Boesen ..... H04M 1/6066 381/380
2004/0042629 A1 * 3/2004 Mellone ..... H04R 1/1058 381/310
2006/0045304 A1 * 3/2006 Lee ..... H04R 1/1041 381/384
2006/0126881 A1 * 6/2006 Ito ..... H04R 1/1033 381/374
2007/0036363 A1 * 2/2007 Hollemans ..... H04R 1/1041 381/59
2009/0154739 A1 * 6/2009 Zellner ..... H04R 1/1041 381/311

(Continued)

*Primary Examiner* — Joshua Kaufman
(74) *Attorney, Agent, or Firm* — Lin & Associates Intellectual Property, Inc.

(57) ABSTRACT

An earphone assembly includes a control box, a first earphone and a second earphone. The control box includes a microprocessor, a first acceleration sensor module, and a sound source output controller electrically connected with the microprocessor. The first acceleration sensor module is electrically connected with the microprocessor for reading three-axis gravity acceleration variation values, and then the three-axis gravity acceleration variation values are transmitted to the microprocessor for calculating a tilt angle of the control box at the time of the earphone assembly being worn. The first earphone is electrically connected with the control box and includes a second acceleration sensor module. The second acceleration sensor module is mounted in the first earphone for reading the three-axis gravity acceleration variation values. The second earphone is electrically connected with the control box.

19 Claims, 8 Drawing Sheets

(56) References Cited

U.S. PATENT DOCUMENTS

| | | | | |
|---|---|---|---|---|
| 2010/0020982 | A1* | 1/2010 | Brown | H04R 1/1041 381/74 |
| 2010/0020998 | A1* | 1/2010 | Brown | H04R 1/1041 381/380 |
| 2010/0053210 | A1* | 3/2010 | Kon | H04S 1/002 345/620 |
| 2010/0246847 | A1* | 9/2010 | Johnson, Jr. | H04R 1/1041 381/74 |
| 2010/0310087 | A1* | 12/2010 | Ishida | H04R 1/1041 381/74 |
| 2011/0051947 | A1* | 3/2011 | Macours | H04R 5/04 381/71.6 |
| 2012/0002822 | A1* | 1/2012 | Peissig | G06F 3/012 381/74 |
| 2012/0114154 | A1* | 5/2012 | Abrahamsson | H04R 5/033 381/309 |
| 2013/0256345 | A1* | 10/2013 | Larkin | A45C 11/00 224/201 |
| 2013/0279724 | A1* | 10/2013 | Stafford | H04R 1/1041 381/309 |

* cited by examiner

EARPHONE ASSEMBLY AND SOUND CHANNEL CONTROL METHOD APPLIED THEREIN

BACKGROUND OF THE INVENTION

1. Field of the Invention

The present invention generally relates to an earphone assembly and a control method, and more particularly to an earphone assembly capable of automatically choosing and transmitting corresponding sound channel signals according to wearing positions of the earphone assembly, and a sound channel control method applied in the earphone assembly.

2. The Related Art

A conventional earphone assembly need be connected with an electronic equipment in use. The conventional earphone assembly is capable of being used as a stereo earphone assembly. The electronic equipment outputs a left sound channel signal and a right sound channel signal, respectively. The conventional earphone need be equipped with a left sound channel earphone and a right sound channel earphone corresponding to the left sound channel signal and the right sound channel signal outputted by the electronic equipment, respectively. In order to make sounds heard from the electronic equipment have stereophonic effects, the left sound channel earphone need be worn to a left ear of a user, and the right sound channel earphone need be worn to a right ear of the user. In order to distinguish the left sound channel earphone from the right sound channel earphone, a conventional method is to carve an "L" on the left sound channel earphone and carve "R" on the right sound channel earphone.

However, when the user uses the earphone assembly, the user will be usually incapable of deliberately distinguishing the left sound channel earphone from the right sound channel earphone, so that a better listening effect has no way of being had when the conventional earphone assembly is worn by the user, if the user wants to have the better listening effect, wearing positions of the left sound channel earphone and the right sound channel earphone need be readjusted.

Thus, in order to solve the problems described above, an innovative earphone assembly and a sound channel control method applied in the innovative earphone assembly are essential to be provided, after a user wears the innovative earphone assembly, the innovative earphone assembly is capable of automatically choosing and transmitting corresponding sound channel signals according to wearing positions of the innovative earphone assembly, and the user will be usually without needing to deliberately distinguish the left sound channel earphone from the right sound channel earphone, so that a usage convenience of the innovative earphone assembly is improved.

SUMMARY OF THE INVENTION

An object of the present invention is to provide an earphone assembly adapted for being electrically connected with an electronic equipment. The earphone assembly includes a control box electrically connected with the electronic equipment, a first earphone and a second earphone. The electronic equipment is used for transmitting left sound channel signals and right sound channel signals to the control box. The control box includes a microprocessor processing the left sound channel signals and the right sound channel signals transmitted from the electronic equipment, a first acceleration sensor module and a sound source output controller. The first acceleration sensor module is electrically connected with the microprocessor for reading three-axis gravity acceleration variation values, and then the three-axis gravity acceleration variation values are transmitted to the microprocessor for calculating a tilt angle of the control box at the time of the earphone assembly being worn. The sound source output controller is electrically connected with the microprocessor, and after the left sound channel signals and the right sound channel signals are transmitted to the sound source output controller from the electronic equipment and processed by the microprocessor, the left sound channel signals and the right sound channel signals can be switched if necessary and transmitted by virtue of the sound source output controller. The first earphone is electrically connected with the control box and receives the left sound channel signals or the right sound channel signals outputted from the sound source output controller. The first earphone includes a second acceleration sensor module, and a first drive monomer for playing the left sound channel signals or the right sound channel signals outputted from the sound source output controller. The second acceleration sensor module is mounted in the first earphone for reading the three-axis gravity acceleration variation values, and then the three-axis gravity acceleration variation values are transmitted to the microprocessor to calculate a tilt angle of the first earphone at the time of the first earphone being worn. The second earphone is electrically connected with the control box for receiving the left sound channel signals or the right sound channel signals transmitted from the sound source output controller. The second earphone includes a second drive monomer mounted in the second earphone for playing the left sound channel signals or the right sound channel signals outputted from the sound source output controller.

Another object of the present invention is to provide a sound channel control method applied in an earphone assembly. The earphone assembly includes a control box, a first earphone and a second earphone. The control box includes a microprocessor and a first acceleration sensor module. The first earphone is electrically connected with the control box and includes a first detecting module and a second acceleration sensor module. The second earphone is electrically connected with the control box and includes a second detecting module. Specific steps of the sound channel control method are described hereinafter. Start the earphone assembly, and the first detecting module and the second detecting module detect whether the user has worn the first earphone and the second earphone in the left ear and the right ear of the user, respectively. When the first detecting module and the second detecting module detect the user has worn the first earphone and the second earphone in the left ear and the right ear, respectively, execute the next step. The three-axis gravity acceleration variation values of the first acceleration sensor module and the second acceleration sensor module are respectively read, and then the three-axis gravity acceleration variation values of the first acceleration sensor module and the second acceleration sensor module are transmitted to the microprocessor to calculate tilt angles of the control box and the first earphone at the time of the first earphone together with the control box being worn. Judge which of the left ear and the right ear of the user is each of the first earphone and the second earphone worn in according to the tilt angles of the control box and the first earphone at the time of the first earphone together with the control box being worn, and then the corresponding left sound channel signals and the right sound channel signals are outputted to the first earphone and the second earphone, respectively according to specific wearing statuses of the first earphone and the second earphone.

Another object of the present invention is to provide an earphone assembly. The earphone assembly includes a control box and a first earphone. The control box includes a microprocessor and a first acceleration sensor module. The first acceleration sensor module for reading three-axis gravity acceleration variation values of the control box, and then the three-axis gravity acceleration variation values of the control box are transmitted to the microprocessor for calculating a tilt angle of the control box. The first earphone electrically connected with the control box, includes a second acceleration sensor module. The second acceleration sensor module for reading three-axis gravity acceleration variation values of the first earphone, and then the three-axis gravity acceleration variation values of the first earphone are transmitted to the microprocessor to calculate a tilt angle of the first earphone. The microprocessor calculates the tilt angle of the control box and the tilt angle of the first earphone by the three-axis gravity acceleration variation values of the control box and the first earphone for judging which of a left ear or a right ear of a user is the first earphone worn in.

As described above, the earphone assembly applying the sound channel control method to judge which of the left ear and the right ear is the first earphone or the second earphone worn in by virtue of the tilt angles of the first earphone and the control box calculated at the time of the first earphone together with the control box being worn and according to the three-axis gravity acceleration variation values of the first acceleration sensor module and the second acceleration sensor module, the left sound channel signals and the right sound channel signals are outputted to the first drive monomer and the second drive monomer, respectively according to the specific wearing statuses of the first earphone and the second earphone, comparing with the conventional earphone assembly in prior art, the user dispenses with distinguishing the right sound channel earphone from the left sound channel earphone, so that a usage convenience of the earphone assembly which is used as a stereo earphone is improved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
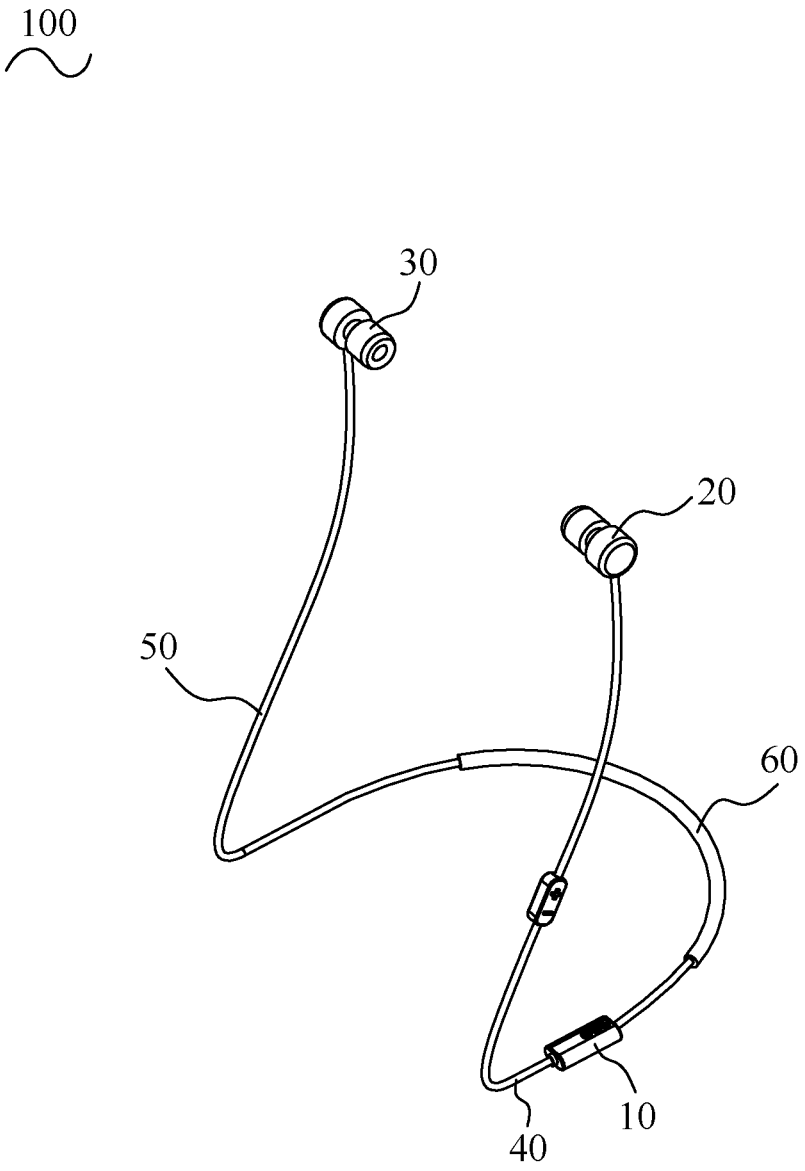
FIG. 1 is a perspective view of an earphone assembly in accordance with a preferred embodiment of the present invention, wherein a sound channel control method is applied in the earphone assembly.
Figure 2:
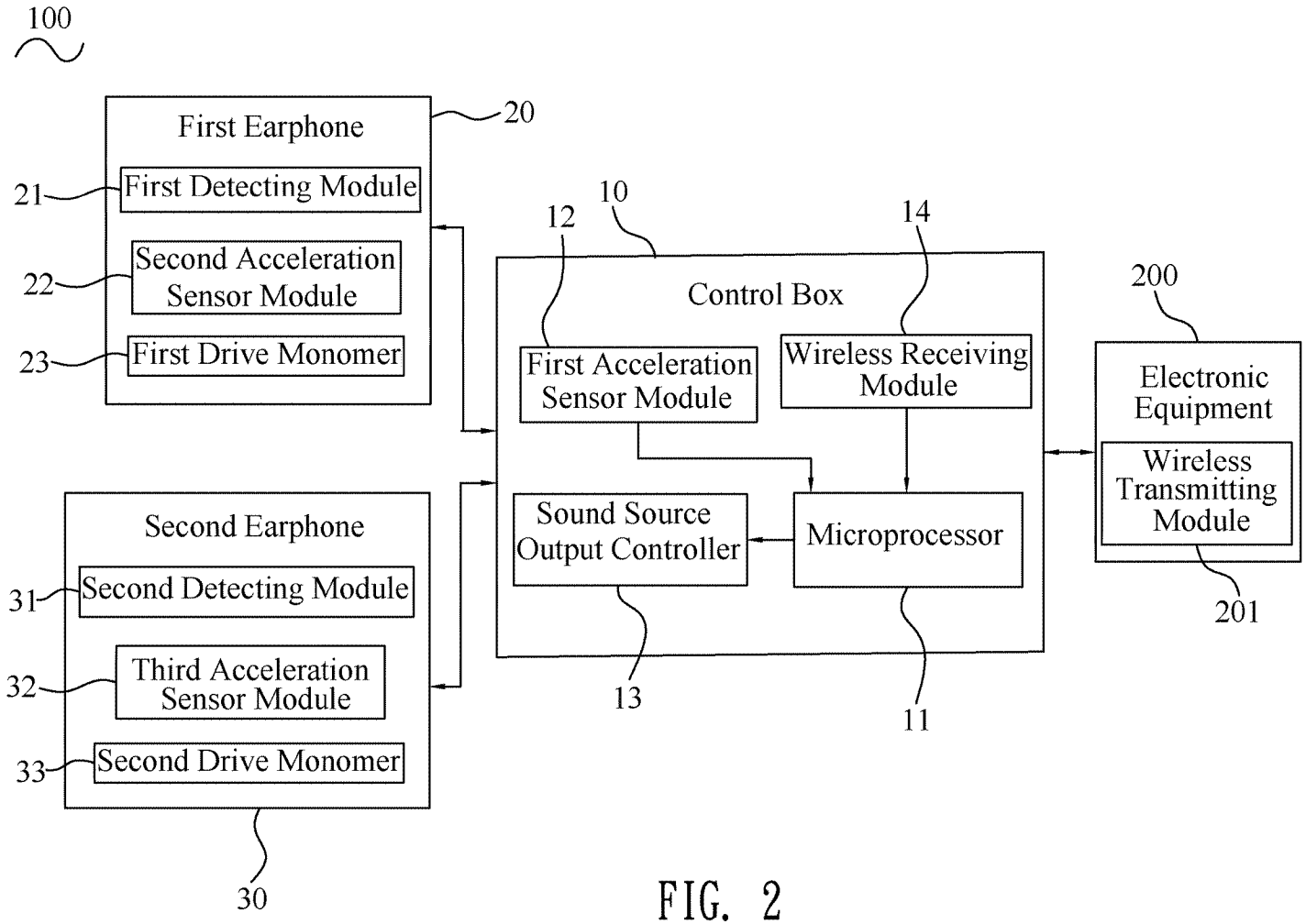
FIG. 2 is a block diagram of the earphone assembly of FIG. 1.
Figure 3:
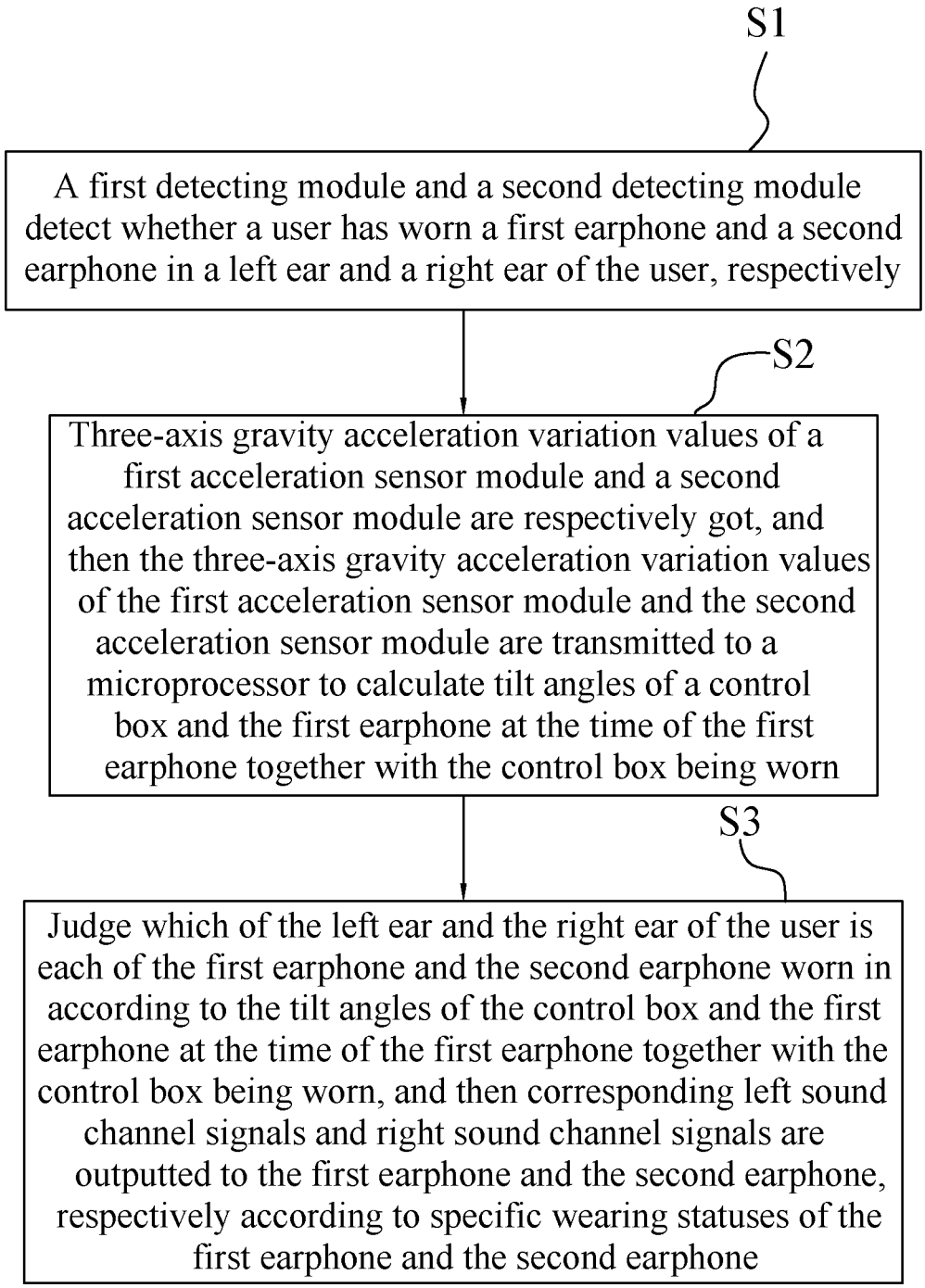
FIG. 3 is a process diagram of the sound channel control method applied in the earphone assembly of FIG. 1.

With reference to FIG. 1 and FIG. 2, an earphone assembly 100 in accordance with a preferred embodiment of the present invention is shown. The earphone assembly 100 is adapted for being electrically connected with an electronic equipment 200. The earphone assembly 100 includes a control box 10, a first earphone 20 and a second earphone 30.

With reference to FIG. 1 and FIG. 2, the control box 10 is electrically connected with the electronic equipment 200, the electronic equipment 200 is used for transmitting left sound channel signals and right sound channel signals to the control box 10. The electronic equipment 200 is equipped with a wireless transmitting module 201. The control box 10 includes a microprocessor 11, a first acceleration sensor module 12, a sound source output controller 13 and a wireless receiving module 14. The microprocessor 11 processes the left sound channel signals and the right sound channel signals transmitted from the electronic equipment 200. The first acceleration sensor module 12 is electrically connected with the microprocessor 11 for reading three-axis gravity acceleration variation values of the control box 10, and then the three-axis gravity acceleration variation values of the control box 10 are transmitted to the microprocessor 11 for calculating a tilt angle of the control box 10 at the time of the earphone assembly 100 being worn.

The sound source output controller 13 is electrically connected with the microprocessor 11. After the left sound channel signals and the right sound channel signals are transmitted to the sound source output controller 13 from the electronic equipment 200 and processed by the microprocessor 11, the left sound channel signals and the right sound channel signals can be switched if necessary and transmitted by virtue of the sound source output controller 13.

In the preferred embodiment, the wireless receiving module 14 is wirelessly connected with the wireless transmitting module 201, so a wireless transmission is adopted between the control box 10 and the electronic equipment 200. The wireless receiving module 14 is electrically connected with the microprocessor 11. The wireless receiving module 14 is used for receiving the left sound channel signals and the right sound channel signals transmitted by the wireless transmitting module 201, and the wireless receiving module 14 transmits the received left sound channel signals and the right sound channel signals to the microprocessor 11.

Referring to FIG. 1 and FIG. 2 again, the first earphone 20 is electrically connected with the control box 10 and receives the left sound channel signals or the right sound channel signals outputted from the sound source output controller 13. The first earphone 20 includes a first detecting module 21, a second acceleration sensor module 22 and a first drive monomer 23. The second earphone 30 is electrically connected with the control box 10 for receiving the left sound channel signals or the right sound channel signals transmitted from the sound source output controller 13. The second earphone 30 includes a second detecting module 31, a third acceleration sensor module 32 and a second drive monomer 33. The microprocessor 11 controls the sound source output controller 13 to output the left sound channel signals and the right sound channel signals to the first drive monomer 23 and the second drive monomer 33, respectively according to specific wearing statuses of the first earphone 20 and the second earphone 30.

Figure 7:
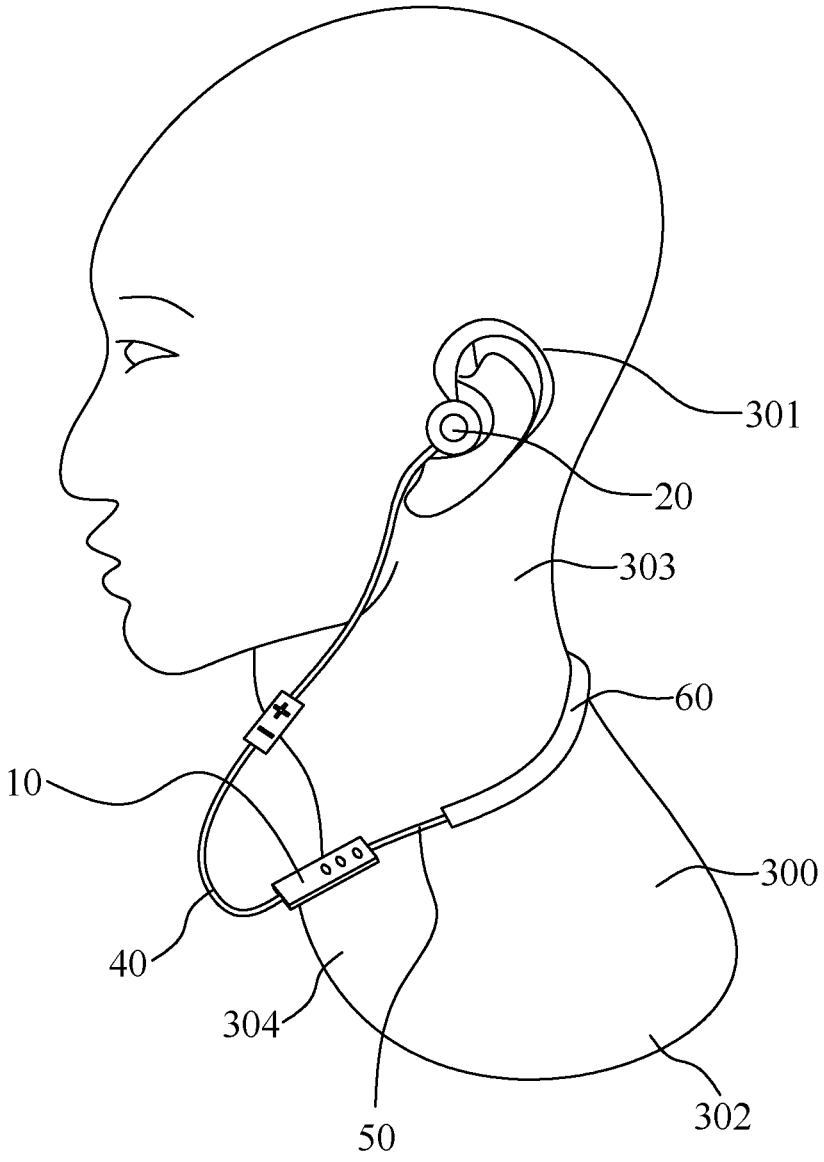
FIG. 7 is a schematic diagram of testing the earphone assembly, wherein the first earphone is worn in the left ear and the second earphone is worn in the right ear.

Referring to FIG. 1, FIG. 2 and FIG. 7, the first detecting module 21 mounted in the first earphone 20 is used for transmitting a touching status of the first detecting module 21 of the first earphone 20 to the microprocessor 11 and detecting whether the first earphone 20 is worn in an ear 301 of a user 300. The user 300 includes the two ears 301 which are a left ear and a right ear. The wireless receiving module 14 is capable of being wirelessly connected with the wireless transmitting module 201 by a bluetooth technology. The second acceleration sensor module 22 mounted in the first earphone 20 is used for reading three-axis gravity acceleration variation values of the first earphone 20, and then the three-axis gravity acceleration variation values of the first earphone 20 are transmitted to the microprocessor 11 to calculate a tilt angle of the first earphone 20 at the time of the first earphone 20 being worn. The microprocessor 11 calculates the tilt angle of the control box 10 and the tilt angle of the first earphone 20 by the three-axis gravity acceleration variation values of the control box 10 and the first earphone 20 for judging which of the left ear or the right ear of the user 300 is the first earphone 20 worn in. The first drive monomer 23 is used for playing the left sound channel signals or the right sound channel signals outputted from the sound source output controller 13. When the first earphone 20 is worn in the left ear of the user 300, the first drive monomer 23 is used for playing the left sound channel signals. When the first earphone 20 is worn in the right ear of the user 300, the first drive monomer 23 is used for playing the right sound channel signals.

The second detecting module 31 mounted in the second earphone 30 is used for transmitting a touching status of the second detecting module 31 of the second earphone 30 to the microprocessor 11 and detecting whether the second earphone 30 is worn in the ear 301 of the user 300. The third acceleration sensor module 32 mounted in the second earphone 30 is used for reading three-axis gravity acceleration variation values of the second earphone 30, and then the three-axis gravity acceleration variation values of the second earphone 30 are transmitted to the microprocessor 11 to calculate a tilt angle of the second earphone 30 at the time of the second earphone 30 being worn. The microprocessor 11 calculates the tilt angle of the second earphone 30 by the three-axis gravity acceleration variation values of the second earphone 30, and then the microprocessor 11 judges which of the left ear and the right ear of the user 300 is each of the first earphone 20 and the second earphone 30 worn in according to the tilt angles of the control box 10, the first earphone 20 and the second earphone 30. In the preferred embodiment, the first detecting module 21 and the second detecting module 31 are capacitance detecting modules. The second drive monomer 33 mounted in the second earphone 30 is used for playing the left sound channel signals or the right sound channel signals outputted from the sound source output controller 13. When the second earphone 30 is worn in the right ear of the user 300, the second drive monomer 33 is used for playing the right sound channel signals. When the second earphone 30 is worn in the left ear of the user 300, the second drive monomer 33 is used for playing the left sound channel signals.

Referring to FIG. 1, FIG. 2 and FIG. 7, two opposite ends of the control box 10 are equipped with a first cable 40 and a second cable 50 corresponding to the first earphone 20 and the second earphone 30, respectively. The first earphone 20 and the second earphone 30 are electrically connected with the control box 10 respectively by means of the first cable 40 and the second cable 50. An outside of one end of the first cable 40 or the second cable 50 adjacent to the control box 10 is fastened with a fastening portion 60. The fastening portion 60 is of an arc shape. Preferably, the fastening portion 60 is of a semicircular shape. When the user 300 uses the earphone assembly 100, the fastening portion 60 is used for being worn around a neck 303 of the user 300 for preventing the earphone assembly 100 from falling off. In the preferred embodiment, the fastening portion 60 is fastened to the outside of the one end of the second cable 50 adjacent to the control box 10, after the fastening portion 60 is worn around the neck 303 of the user 300, the control box 10 will be located at a shoulder 302, and the shoulder 302 which the control box 10 will be located at and the ear 301 which the first earphone 20 is worn in are located at the same side of the user 300. For example, when the first earphone 20 is worn in the left ear, the control box 10 is located at a left side shoulder 302 of the user 300.

Referring to FIG. 1 to FIG. 8, a sound channel control method is applied in the earphone assembly 100. Specific steps of the sound channel control method are described as follows.

S1, start the earphone assembly 100, the first detecting module 21 and the second detecting module 31 detect whether the user 300 has worn the first earphone 20 and the second earphone 30 in the left ear and the right ear of the user 300, respectively. When the first detecting module 21 and the second detecting module 31 detect the user 300 has worn the first earphone 20 and the second earphone 30 in the left ear and the right ear, respectively, execute the next step S2.

S2, the three-axis gravity acceleration variation values of the first acceleration sensor module 12 of the control box 10 and the second acceleration sensor module 22 of the first earphone 20 are respectively read, and then the three-axis gravity acceleration variation values of the first acceleration sensor module 12 and the second acceleration sensor module 22 are transmitted to the microprocessor 11 to calculate the tilt angles of the control box 10 and the first earphone 20 at the time of the first earphone 20 together with the control box 10 being worn.

Preferably, the three-axis gravity acceleration variation values of the first acceleration sensor module 12 of the control box 10, the second acceleration sensor module 22 of the first earphone 20 and the third acceleration sensor module 32 of the second earphone 30 are read separately, and then the three-axis gravity acceleration variation values of the first acceleration sensor module 12, the second acceleration sensor module 22 and the third acceleration sensor module 32 are transmitted to the microprocessor 11 to calculate the tilt angles of the control box 10, the first earphone 20 and the second earphone 30 at the time of the earphone assembly 100 being worn.

S3, judge which of the left ear and the right ear of the user 300 is each of the first earphone 20 and the second earphone 30 worn in according to the tilt angles of the control box 10 and the first earphone 20 at the time of the first earphone 20 together with the control box 10 being worn, and then the corresponding left sound channel signals and the right sound channel signals are outputted to the first earphone 20 and the second earphone 30, respectively according to the specific wearing statuses of the first earphone 20 and the second earphone 30.

Preferably, judge which of the left ear and the right ear of the user 300 is each of the first earphone 20 and the second earphone 30 worn in according to the tilt angles of the control box 10, the first earphone 20 and the second earphone 30 at the time of the earphone assembly 100 being worn, and then the corresponding left sound channel signals and the right sound channel signals are outputted to the first earphone 20 and the second earphone 30, respectively according to the specific wearing statuses of the first earphone 20 and the second earphone 30.

Figure 4:
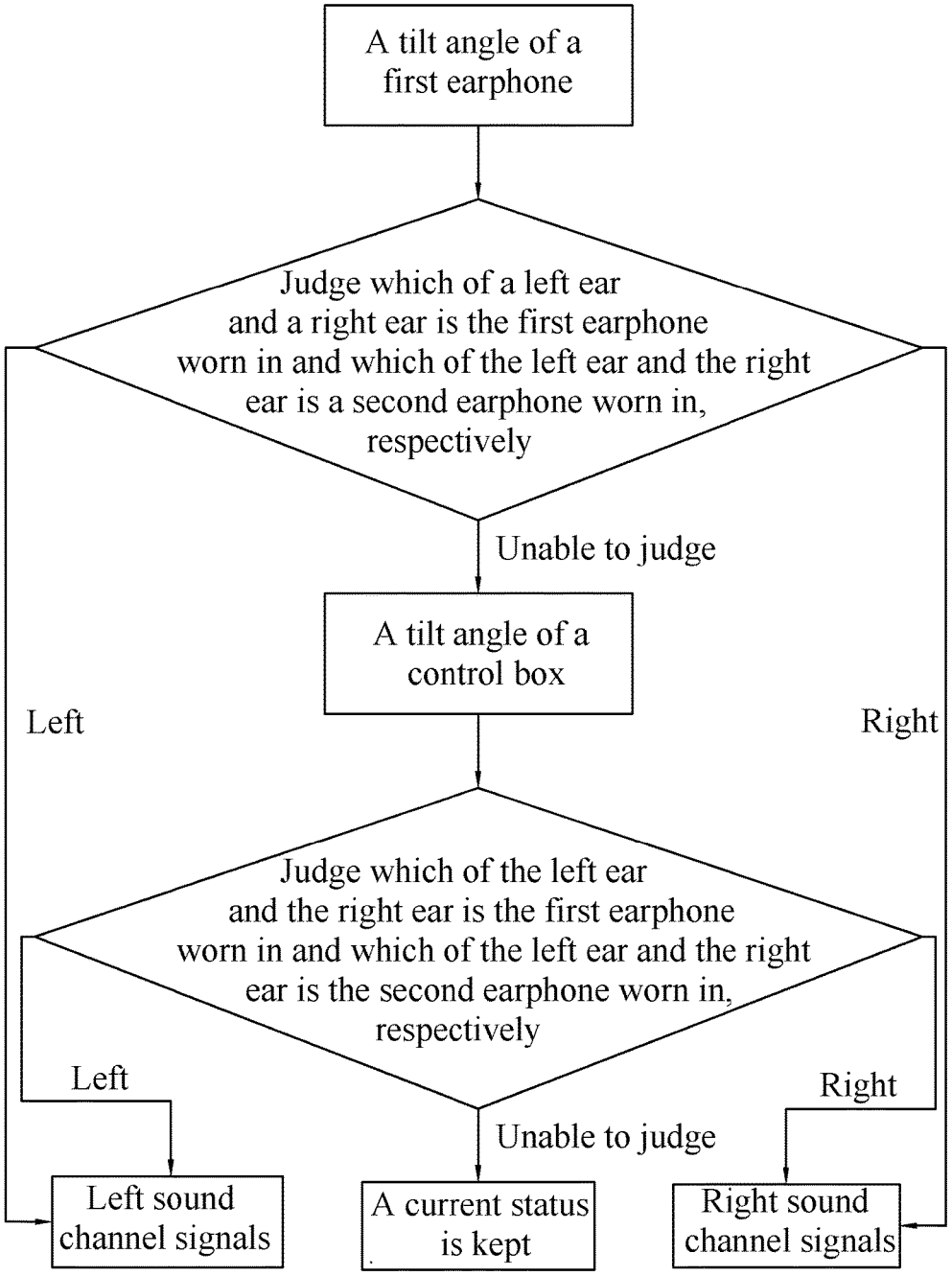
FIG. 4 is a specific flowchart of judging which of a left ear and a right ear is a first earphone worn in and which of the left ear and the right ear is a second earphone worn in, respectively in a step S3 of FIG. 3.
Figure 5:
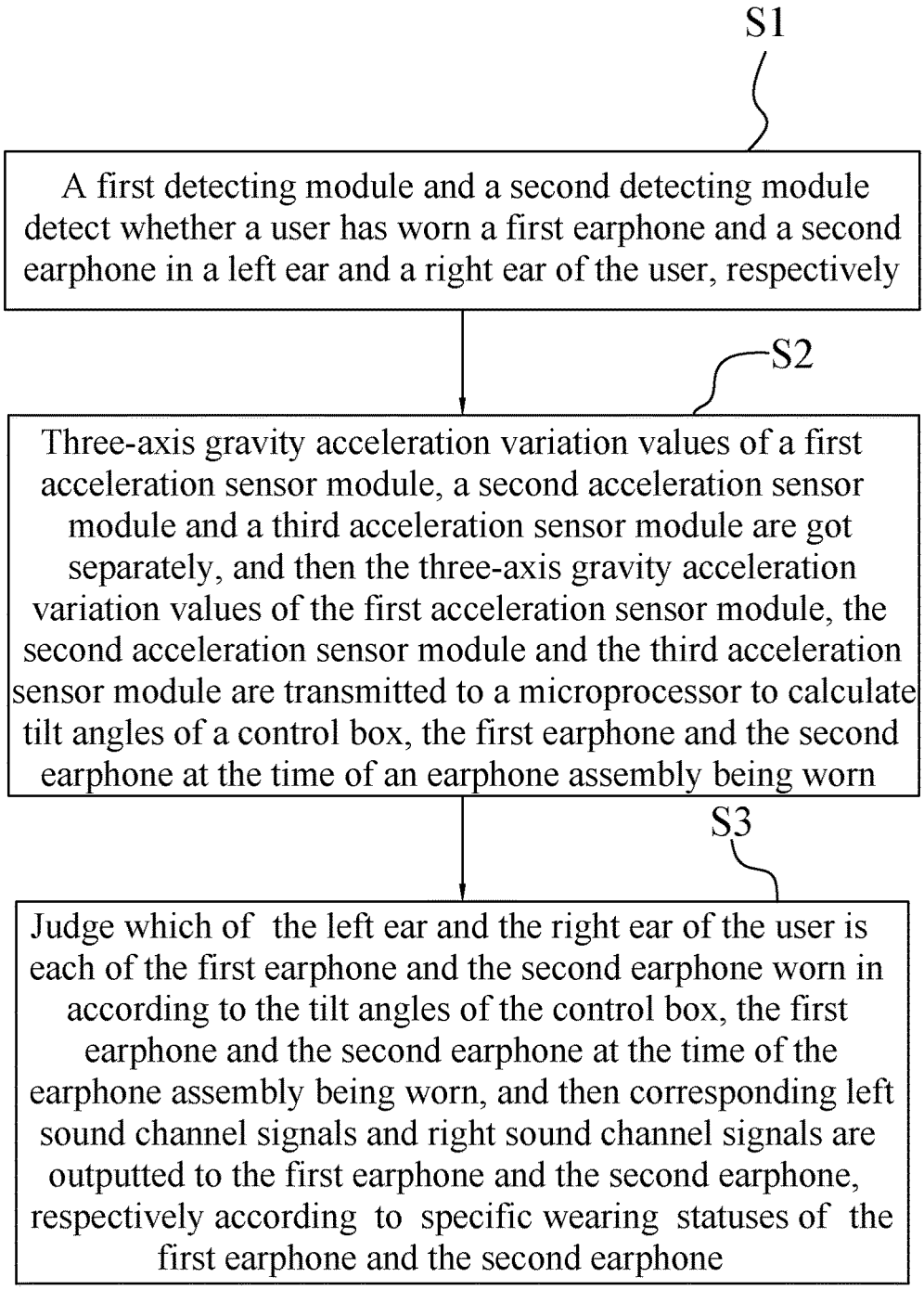
FIG. 5 is another process diagram of the sound channel control method applied in the earphone assembly of FIG. 1.

Referring to FIG. 1, FIG. 4 and FIG. 7, in the step S3, a specific process of judging which of the left ear and the right ear of the user 300 is each of the first earphone 20 and the second earphone 30 worn in is described as follows. Judge which of the left ear and the right ear is the first earphone 20 worn in and which of the left ear and the right ear is the second earphone 30 worn in, respectively according to the tilt angle of the first earphone 20, if it is unable to judge which of the left ear and the right ear is the first earphone 20 worn in and which of the left ear and the right ear is the second earphone 30 worn in, respectively, the tilt angle of the control box 10 is used to judge which of the left ear and the right ear is the first earphone 20 worn in and which of the left ear and the right ear is the second earphone 30 worn in, respectively, so that which of the left ear and the right ear is the first earphone 20 confirmed to be worn in and which of the left ear and the right ear is the second earphone 30 confirmed to be worn in, respectively, if it is still unable to judge by use of the control box 10, a current status is kept, namely the left sound channel signals and the right sound channel signals are outputted according to initial settings of the earphone assembly 100.

Figure 6:
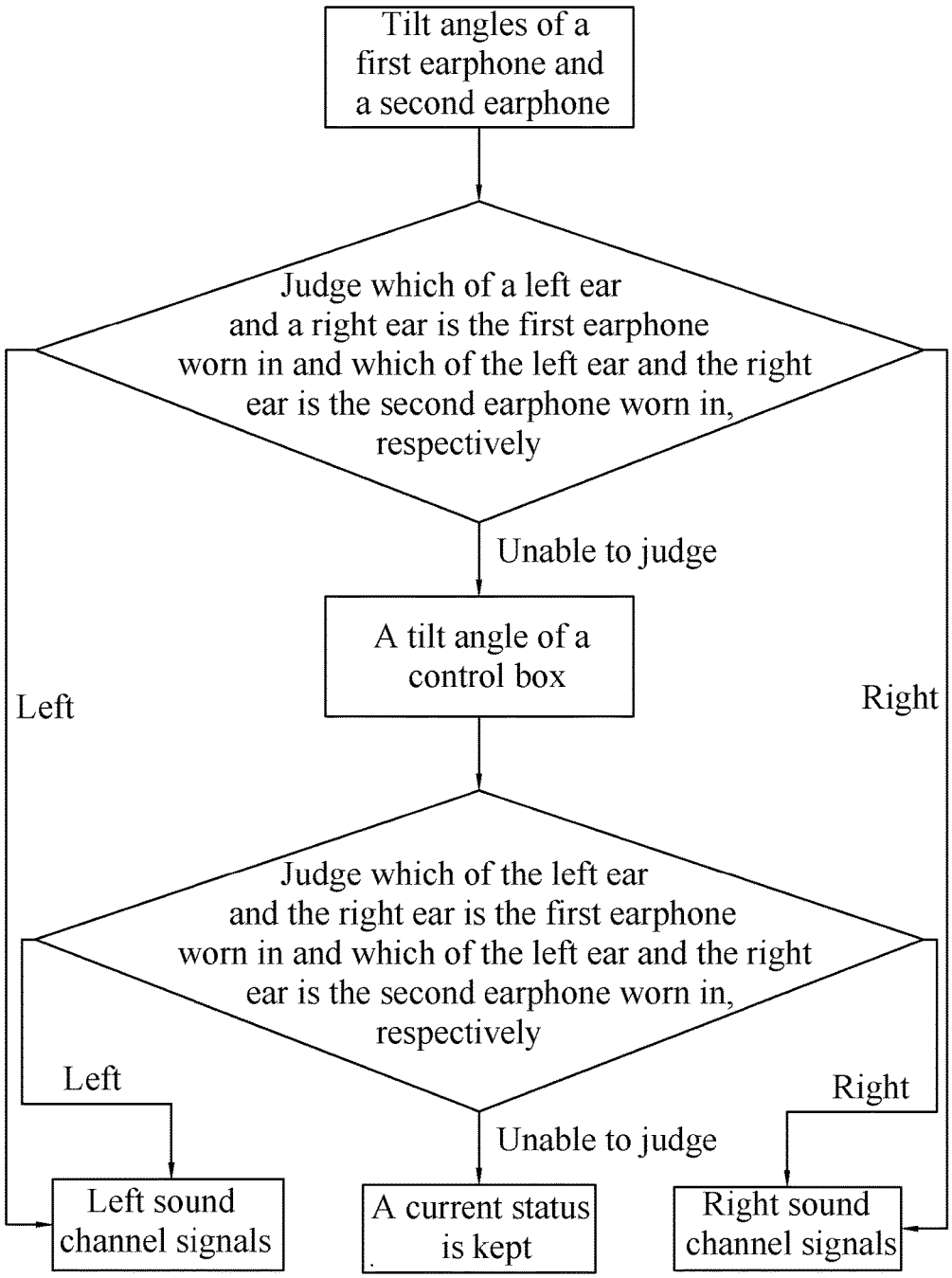
FIG. 6 is another specific flowchart of judging which of the left ear and the right ear is the first earphone worn in and which of the left ear and the right ear is the second earphone worn in, respectively in the step S3 of FIG. 5.

Referring to FIG. 1, FIG. 6 and FIG. 7, preferably, in the step S3, the specific process of judging which of the left ear and the right ear of the user 300 is each of the first earphone 20 and the second earphone 30 worn in is described as follows. Judge which of the left ear and the right ear is the first earphone 20 worn in and which of the left ear and the right ear is the second earphone 30 worn in, respectively according to the tilt angles of the first earphone 20 and the second earphone 30, if it is unable to judge which of the left ear and the right ear is the first earphone 20 worn in and which of the left ear and the right ear is the second earphone 30 worn in, respectively, the tilt angle of the control box 10 is used to judge which of the left ear and the right ear is the first earphone 20 worn in and which of the left ear and the right ear is the second earphone 30 worn in, respectively, so that which of the left ear and the right ear is the first earphone 20 confirmed to be worn in and which of the left ear and the right ear is the second earphone 30 confirmed to be worn in, respectively, if it is still unable to judge by use of the control box 10, the current status is kept, namely the left sound channel signals and the right sound channel signals are outputted according to the initial settings of the earphone assembly 100.

Figure 8:
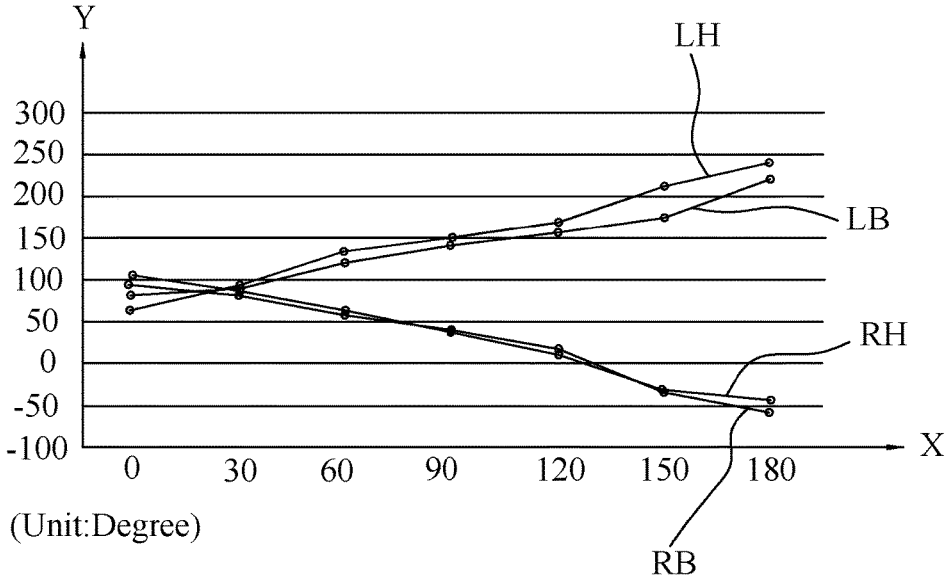
FIG. 8 is a data graph of the earphone assembly in accordance with the preferred embodiment of the present invention applying the sound channel control method.

Referring to FIG. 1, FIG. 2, FIG. 7 and FIG. 8, in FIG. 8, an X coordinate value of an X axis shows an angle of a main body 304 of the user 300 with respect to a horizontal plane. When the user 300 stands, the X coordinate value is 90 degrees, namely, the angle of the main body 304 with respect to the horizontal plane is 90 degrees; when the user 300 gets down and a face of the user 300 faces downward, the X coordinate value is 0 degree, namely, the angle of the main body 304 with respect to the horizontal plane is 0 degree; when the user 300 lies down and the face of the user 300 faces upward, the X coordinate value is 180 degrees, namely the angle of the main body 304 with respect to the horizontal plane is 180 degrees. The X coordinate values that are 30 degrees and 60 degrees denote the angles of the main body 304 of the user 300 lying prostrate being different degrees with respect to the horizontal plane, respectively. Specifically, the X coordinate values that are 30 degrees and 60 degrees denote the angles of the main body 304 of the user 300 lying prostrate being 30 degrees and 60 degrees with respect to the horizontal plane, respectively. The X coordinate values that are 120 degrees and 150 degrees denote the angles of the main body 304 of the user 300 leaning back being different degrees with respect to the horizontal plane, respectively. Specifically, the X coordinate values that are 120 degrees and 150 degrees denote the angles of the main body 304 of the user 300 leaning back being 120 degrees and 150 degrees with respect to the horizontal plane, respectively.

Referring to FIG. 1, FIG. 2, FIG. 7 and FIG. 8, in FIG. 8, a Y coordinate value of a Y axis shows the tilt angle of each of the control box 10 and the first earphone 20 which is calculated according to the three-axis gravity acceleration variation value of one of the first acceleration sensor module 12 and the second acceleration sensor module 22 at the time of the first earphone 20 together with the control box 10 being worn. The tilt angle of each of the control box 10 and the first earphone 20 is calculated by virtue of applying a calculation program. A graph LH and a graph LB show the tilt angles of the first earphone 20 and the control box 10, respectively at the time of the first earphone 20 together with the control box 10 being worn and the first earphone 20 being placed in the left ear and the second earphone 30 being placed in the right ear under the angle of the main body 304 with respect to the horizontal plane ranged between 0 degree and 180 degrees, and according to the three-axis gravity acceleration variation values of the first acceleration sensor module 12 and the second acceleration sensor module 22. A graph RH and a graph RB show the tilt angles of the first earphone 20 and the control box 10, respectively at the time of the first earphone 20 together with the control box 10 being worn and the first earphone 20 being placed in the right ear and the second earphone 30 being placed in the left ear under the angle of the main body 304 with respect to the horizontal plane ranged between 0 degree and 180 degrees, and according to the three-axis gravity acceleration variation values of the first acceleration sensor module 12 and the second acceleration sensor module 22.

Referring to FIG. 1, FIG. 2, FIG. 7 and FIG. 8, in FIG. 8, preferably, the Y coordinate value of the Y axis shows the tilt angle of each of the control box 10, the first earphone 20 and the second earphone 30 which is calculated according to the three-axis gravity acceleration variation value of one of the first acceleration sensor module 12, the second acceleration sensor module 22 and the third acceleration sensor module 32 at the time of the earphone assembly 100 being worn. The tilt angle of each of the control box 10, the first earphone 20 and the second earphone 30 is calculated by virtue of applying the calculation program. A graph LH and a graph LB show the tilt angles of the control box 10, the first earphone 20 and the second earphone 30 separately at the time of the earphone assembly 100 being worn, and the first earphone 20 being disposed in the left ear and the second earphone 30 being disposed in the right ear under the angle of the main body 304 with respect to the horizontal plane ranged between 0 degree and 180 degrees, and according to the three-axis gravity acceleration variation values of the first acceleration sensor module 12, the second acceleration sensor module 22 and the third acceleration sensor module 32. RH and RB show the tilt angles of the control box 10, the first earphone 20 and the second earphone 30 at the time of the earphone assembly 100 being worn, and the first earphone 20 being disposed in the right ear and the second earphone 30 being disposed in the left ear under the angle of the main body 304 with respect to the horizontal plane ranged between 0 degree and 180 degrees, and according to the three-axis gravity acceleration variation values of the first acceleration sensor module 12, the second acceleration sensor module 22 and the third acceleration sensor module 32.

In the preferred embodiment, limit values of confirming which of the left ear and the right ear is each of the first earphone 20 and the second earphone 30 worn in are 63 degrees and 121 degrees, respectively. When each of the first earphone 20 and the second earphone 30 is worn in one ear 301 of the user 300, the tilt angles of the first earphone 20 and the control box 10 calculated at the time of the first earphone 20 together with the control box 10 being worn and according to the three-axis gravity acceleration variation values of the first acceleration sensor module 12 and the second acceleration sensor module 22 are both greater than 121 degrees, the first earphone 20 is judged to be worn in the left ear and the second earphone 30 is judged to be worn in the right ear, preferably, when each of the first earphone 20 and the second earphone 30 is worn in the one ear 301 of the user 300, the tilt angles of the control box 10, the first earphone 20 and the second earphone 30 calculated at the time of the earphone assembly 100 being worn and according to the three-axis gravity acceleration variation values of the first acceleration sensor module 12, the second acceleration sensor module 22 and the third acceleration sensor module 32 are all greater than 121 degrees, the first earphone 20 is judged to be worn in the left ear and the second earphone 30 is judged to be worn in the right ear.

When each of the first earphone 20 and the second earphone 30 is worn in the one ear 301 of the user 300, the tilt angles of the first earphone 20 and the control box 10 calculated at the time of the first earphone 20 together with the control box 10 being worn and according to the three-axis gravity acceleration variation values of the first acceleration sensor module 12 and the second acceleration sensor module 22 are both less than 63 degrees, the first earphone 20 is judged to be worn in the right ear and the second earphone 30 is judged to be worn in the left ear; preferably, when each of the first earphone 20 and the second earphone 30 is worn in the one ear 301 of the user 300, the tilt angles of the control box 10, the first earphone 20 and the second earphone 30 calculated at the time of the earphone assembly 100 being worn and according to the three-axis gravity acceleration variation values of the first acceleration sensor module 12, the second acceleration sensor module 22 and the third acceleration sensor module 32 are all less than 63 degrees, the first earphone 20 is judged to be worn in the right ear and the second earphone 30 is worn in the left ear. The left sound channel signals and the right sound channel signals are outputted to the first drive monomer 23 and the second drive monomer 33, respectively according to the specific wearing statuses of the first earphone 20 and the second earphone 30.

As described above, the earphone assembly 100 applying the sound channel control method to judge which of the left ear and the right ear is the first earphone 20 or the second earphone 30 worn in by virtue of the tilt angles of the first earphone 20 and the control box 10 calculated at the time of the first earphone 20 together with the control box 10 being worn and according to the three-axis gravity acceleration variation values of the first acceleration sensor module 12 and the second acceleration sensor module 22, the left sound channel signals and the right sound channel signals are outputted to the first drive monomer 23 and the second drive monomer 33, respectively according to the specific wearing statuses of the first earphone 20 and the second earphone 30, comparing with the conventional earphone assembly in prior art, the user 300 dispenses with distinguishing the right sound channel earphone from the left sound channel earphone, so that a usage convenience of the earphone assembly 100 which is used as a stereo earphone is improved.

What is claimed is:

1. An earphone assembly adapted for being electrically connected with an electronic equipment, comprising:

a control box electrically connected with the electronic equipment, the electronic equipment being used for transmitting left sound channel signals and right sound channel signals to the control box, the control box including a microprocessor processing the left sound channel signals and the right sound channel signals transmitted from the electronic equipment, a first acceleration sensor module electrically connected with the microprocessor for reading three-axis gravity acceleration variation values, and then the three-axis gravity acceleration variation values being transmitted to the microprocessor for calculating a tilt angle of the control box at the time of the earphone assembly being worn, and a sound source output controller electrically connected with the microprocessor, after the left sound channel signals and the right sound channel signals are transmitted to the sound source output controller from the electronic equipment and processed by the microprocessor, the left sound channel signals and the right sound channel signals being switched optionally and then transmitted by virtue of the sound source output controller;

a first earphone electrically connected with the control box and receiving the left sound channel signals or the right sound channel signals outputted from the sound source output controller, the first earphone including a second acceleration sensor module mounted in the first earphone for reading the three-axis gravity acceleration variation values, and then the three-axis gravity acceleration variation values being transmitted to the microprocessor to calculate a tilt angle of the first earphone at the time of the first earphone being worn, and a first drive monomer for playing the left sound channel signals or the right sound channel signals outputted from the sound source output controller; and a second earphone electrically connected with the control box for receiving the left sound channel signals or the right sound channel signals transmitted from the sound source output controller, the second earphone including a second drive monomer mounted in the second earphone for playing the left sound channel signals or the right sound channel signals outputted from the sound source output controller;

wherein the microprocessor is programmed to execute a specific process of judging which of a left ear and a right ear of a user is each of the first earphone and the second earphone worn in for outputting the left sound channel signals and the right sound channel signals, the specific process including:

a first step of judging which of the left ear and the right ear is the first earphone worn in and which of the left ear and the right ear is the second earphone worn in respectively according to the tilt angle of the first earphone;

a second step of judging which of the left ear and the right ear is the first earphone worn in and which of the left ear and the right ear is the second earphone worn in respectively according to the tilt angle of the control box if the first step is unable to judge, and a third step of keeping a current status if the second step is still unable to judge, namely, outputting the left sound channel signals and the right sound channel signals according to initial settings of the earphone assembly.

2. The earphone assembly as claimed in claim 1, wherein the first earphone further includes a first detecting module mounted in the first earphone for detecting whether the first earphone is worn in an ear of the user, the second earphone further includes a second detecting module mounted in the second earphone for detecting whether the second earphone is worn in the ear of the user, and the first detecting module and the second detecting module are capacitance detecting modules.

3. The earphone assembly as claimed in claim 1, wherein the second earphone further includes a third acceleration sensor module mounted in the second earphone for reading the three-axis gravity acceleration variation values, and then the three-axis gravity acceleration variation values are transmitted to the microprocessor to calculate a tilt angle of the second earphone at the time of the second earphone being worn.

4. The earphone assembly as claimed in claim 1, wherein the control box further includes a wireless receiving module electrically connected with the microprocessor, the electronic equipment is equipped with a wireless transmitting module, the wireless receiving module is wirelessly connected with the wireless transmitting module, the wireless receiving module is used for receiving the left sound channel signals and the right sound channel signals transmitted by the wireless transmitting module, and the wireless receiving module transmits the received left sound channel signals and the right sound channel signals to the microprocessor.

5. The earphone assembly as claimed in claim 1, wherein two opposite ends of the control box are equipped with a first cable and a second cable corresponding to the first earphone and the second earphone, respectively, and the first earphone and the second earphone are electrically connected with the control box respectively by means of the first cable and the second cable.

6. The earphone assembly as claimed in claim 5, wherein an outside of one end of the first cable adjacent to the control box is fastened with a fastening portion.

7. The earphone assembly as claimed in claim 6, wherein the fastening portion is of an arc shape.

8. The earphone assembly as claimed in claim 6, wherein the fastening portion is of a semicircular shape.

9. The earphone assembly as claimed in claim 5, wherein an outside of one end of the second cable adjacent to the control box is fastened with a fastening portion.

10. The earphone assembly as claimed in claim 9, wherein the fastening portion is of an arc shape.

11. The earphone assembly as claimed in claim 9, wherein the fastening portion is of a semicircular shape.

12. A sound channel control method applied in an earphone assembly, the earphone assembly including a control box, a first earphone and a second earphone, the control box including a microprocessor and a first acceleration sensor module, the first earphone electrically connected with the control box, including a first detecting module and a second acceleration sensor module, the second earphone electrically connected with the control box, including a second detecting module, the sound channel control method comprising the steps of:

starting the earphone assembly, the first detecting module and the second detecting module detecting whether a user has worn the first earphone and the second earphone in a left ear and a right ear of the user, respectively, and when the first detecting module and the second detecting module detect the user has worn the first earphone and the second earphone in the left ear and the right ear, respectively, executing the next step;

reading three-axis gravity acceleration variation values of the first acceleration sensor module and the second acceleration sensor module respectively, and then transmitting the three-axis gravity acceleration variation values of the first acceleration sensor module and the second acceleration sensor module to the microprocessor to calculate tilt angles of the control box and the first earphone at the time of the first earphone together with the control box being worn; and judging which of the left ear and the right ear of the user is each of the first earphone and the second earphone worn in according to the tilt angles of the control box and the first earphone at the time of the first earphone together with the control box being worn, and then outputting corresponding left sound channel signals and right sound channel signals to the first earphone and the second earphone, respectively according to specific wearing statuses of the first earphone and the second earphone;

wherein judging which of the left ear and the right ear of the user is each of the first earphone and the second earphone worn in is performed by a specific process including:

a first step of judging which of the left ear and the right ear is the first earphone worn in and which of the left ear and the right ear is the second earphone worn in respectively according to the tilt angle of the first earphone;

a second step of judging which of the left ear and the right ear is the first earphone worn in and which of the left ear and the right ear is the second earphone worn in respectively according to the tilt angle of the control box if the first step is unable to judge; and a third step of keeping a current status if the second step is still unable to judge, namely, outputting the left sound channel signals and the right sound channel signals according to initial settings of the earphone assembly.

13. The sound channel control method as claimed in claim 12, wherein limit values of confirming which of the left ear and the right ear is each of the first earphone and the second earphone worn in are 63 degrees and 121 degrees, respectively.

14. The sound channel control method as claimed in claim 13, wherein when each of the first earphone and the second earphone is worn in one ear of the user, the tilt angles of the first earphone and the control box calculated at the time of the first earphone together with the control box being worn and according to the three-axis gravity acceleration variation values of the first acceleration sensor module and the second acceleration sensor module are both greater than 121 degrees, the first earphone is judged to be worn in the left ear and the second earphone is judged to be worn in the right ear, and when each of the first earphone and the second earphone is worn in the one ear of the user, the tilt angles of the first earphone and the control box calculated at the time of the first earphone together with the control box being worn and according to the three-axis gravity acceleration variation values of the first acceleration sensor module and the second acceleration sensor module are both less than 63 degrees, the first earphone is judged to be worn in the right ear and the second earphone is judged to be worn in the left ear.

15. The sound channel control method as claimed in claim 12, wherein the second earphone further includes a third acceleration sensor module, and the sound channel control method further comprises reading three-axis gravity acceleration variation values of the third acceleration sensor module, and then transmitting the three-axis gravity acceleration variation values of the first acceleration sensor module, the second acceleration sensor module and the third acceleration sensor module to the microprocessor to calculate tilt angles of the control box, the first earphone and the second earphone at the time of the earphone assembly being worn, and judging which of the left ear and the right ear of the user is each of the first earphone and the second earphone worn in according to the tilt angles of the control box, the first earphone and the second earphone at the time of the earphone assembly being worn.

16. The sound channel control method as claimed in claim 15, wherein in the specific process of judging which of the left ear and the right ear of the user is each of the first earphone and the second earphone worn in, the first step of judging which of the left ear and the right ear is the first earphone worn in and which of the left ear and the right ear is the second earphone worn in respectively is performed according to the tilt angles of the first earphone and the second earphone.

17. The sound channel control method as claimed in claim 16, wherein limit values of confirming which of the left ear and the right ear is each of the first earphone and the second earphone worn in are 63 degrees and 121 degrees, respectively, when each of the first earphone and the second earphone is worn in one ear of the user, the tilt angles of the control box, the first earphone and the second earphone calculated at the time of the earphone assembly being worn and according to the three-axis gravity acceleration variation values of the first acceleration sensor module, the second acceleration sensor module and the third acceleration sensor module are all greater than 121 degrees, the first earphone is judged to be worn in the left ear and the second earphone is judged to be worn in the right ear, and when each of the first earphone and the second earphone is worn in the one ear of the user, the tilt angles of the control box, the first earphone and the second earphone calculated at the time of the earphone assembly being worn and according to the three-axis gravity acceleration variation values of the first acceleration sensor module, the second acceleration sensor module and the third acceleration sensor module are all less than 63 degrees, the first earphone is judged to be worn in the right ear and the second earphone is worn in the left ear.

18. An earphone assembly, comprising:

a control box, including a microprocessor, and a first acceleration sensor module for reading three-axis gravity acceleration variation values of the control box, and then the three-axis gravity acceleration variation values of the control box being transmitted to the microprocessor for calculating a tilt angle of the control box; and a first earphone electrically connected with the control box, including a second acceleration sensor module for reading three-axis gravity acceleration variation values of the first earphone, and then the three-axis gravity acceleration variation values of the first earphone being transmitted to the microprocessor to calculate a tilt angle of the first earphone, wherein the microprocessor is programmed to execute a specific process of judging which of a left ear and a right ear of a user is the first earphone worn in, the specific process including:

a first step of judging which of the left ear and the right ear is the first earphone worn in according to the tilt angle of the first earphone; and a second step of judging which of the left ear and the right ear is the first earphone worn in according to the tilt angle of the control box if the first step is unable to judge.

19. The earphone assembly as claimed in claim 18, further comprising a second earphone electrically connected with the control box, the second earphone including a third acceleration sensor module for reading three-axis gravity acceleration variation values of the second earphone, and then the microprocessor calculating a tilt angle of the second earphone by the three-axis gravity acceleration variation values of the second earphone, and then the microprocessor judging which of the left ear and the right ear of the user is each of the first earphone and the second earphone worn in according to the tilt angles of the control box, the first earphone and the second earphone.

* * * * *